United States Patent [19]

Doman

[11] Patent Number: 4,778,554

[45] Date of Patent: Oct. 18, 1988

[54] WATER BASED ADHESIVE PACKAGING APPARATUS AND METHOD

[75] Inventor: David G. Doman, North Vancouver, Canada

[73] Assignee: Western Packaging Company, Ltd., Richmond, Canada

[21] Appl. No.: 848,958

[22] Filed: Apr. 7, 1986

[51] Int. Cl.[4] ..... B32B 31/12

[52] U.S. Cl. ..... 156/321; 53/375; 53/388; 53/491; 156/322; 156/499; 493/183

[58] Field of Search ..... 53/375, 388, 491; 156/321, 322, 499; 493/183

[56] References Cited

U.S. PATENT DOCUMENTS

| | | | |
|---|---|---|---|
| 2,987,105 | 6/1961 | Gebbie | 156/356 X |
| 3,616,010 | 10/1971 | Dunholter et al. | 156/210 |
| 3,690,981 | 9/1972 | Di Frank et al. | 156/210 |
| 3,920,496 | 11/1975 | Wilkinson et al. | 156/210 X |

*Primary Examiner*—Robert A. Dawson

*Attorney, Agent, or Firm*—John R. Uren

[57] ABSTRACT

A method and apparatus for rapidly bonding two surfaces which are associated with paper elements and corrugated paper elements. A heater plate is utilized to raise the temperature of one of the surfaces while a water based adhesive is applied to the other of said surfaces, which other surface remains at ambient temperature. The heated and ambient surfaces are subsequently contacted and pressure is applied between the surfaces until the bonding is complete.

12 Claims, 2 Drawing Sheets

WATER BASED ADHESIVE PACKAGING APPARATUS AND METHOD

INTRODUCTION

This invention relates to a bonding method and apparatus and, more particularly, to a bonding method and apparatus for rapidly adhesively bonding two surfaces associated with paper and corrugated paper elements.

BACKGROUND OF THE INVENTION

The use of adhesives to bond two elements, the adhesive being applied to one or both of the contacting surfaces of the elements is, of course, well known. Where time is relatively unimportant, the surfaces are simply pressed together for a suitable duration until the adhesive has cured at which point there will exist a generally satisfactory bond between the surfaces.

Where the time required for bonding takes on significance, however, as in modern packaging and manufacturing operations, the time required for the known bonding process becomes of importance and various techniques have been utilized to decrease the time required for bonding. One such technique is known as the "hot melt" procedure. In this procedure, adhesive which is solid at ambient temperature is heated to a much higher temperature hich liquifies the adhesive. The adhesive is then applied to one or both of the surfaces and the surfaces are held in contact while the adhesive temperature decreases and it again solidifies. This procedure, however, is unsafe due to the high temperature required for the adhesive to liquify and is costly because of the necessity for high heat and an adhesive with the required characteristics.

Another known technique is that disclosed in U.S. Pat. No. 1,851,709 entitled METHOD OF HOT GLUING to Laucks et al. This technique requires one piece of lumber or board to be heated to a temperature relatively higher than the other piece of similar material and, thereafter, joining the heated element with the unheated element by applying pressure between the two pieces. This technique taught by Laucks et al, however, does not contemplate the high speeds required by modern packaging requirements and, in any event, it does not relate to corrugated paper elements which have distinctly different properties relating to pressure and temperature characteristics.

Yet a further known method utilizes adhesive of the water based variety which can be utilized at ambient temperatures. In this technique, high mechanical pressure and small adhesive droplets dispersed over the area to be bonded are utilized. Where fragile contents are used in, for example, the boxes which are desired to be closed, high mechanical pressure cannot be used for fear of damage to the contents. The time required for suitable bonding using this method, however, remains relatively high which is unacceptable.

SUMMARY OF THE INVENTION

According to one aspect of the invention, there is disclosed apparatus for rapidly bonding the outer surfaces of two corrugated paperboard assemblies comprising heat applying means to rapidly raise the temperature of the surface of one of said assemblies to a predetermined value while said surface is being conveyed, adhesive applying means to apply adhesive to the other of said surfaces, closing means to bring said surfaces of said assemblies into contact and pressure means to apply pressure between said contacting surfaces of said assemblies.

According to a further aspect of the invention, there is disclosed a method for rapidly bonding the outer surfaces of two corrugated paper assemblies comprising the steps of applying heat directly to the surface of one of said elements, applying adhesive at ambient temperature to the other of said elements, bringing said surfaces of said elements into a contacting relationship and applying pressure between said surfaces of said elements.

According to yet a further aspect of the invention, there is disclosed a method of bonding first paper tape or cardboard with the surface of a second paper, tape or cardboard element comprising the steps of applying adhesive to one of said first or second elements at ambient temperature, bringing said surface of said other of said first and second elements into contact with the surface of said first element at ambient temperature and applying heat at a predetermined temperature to one of said first or second elements.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENTS

Figure 1:
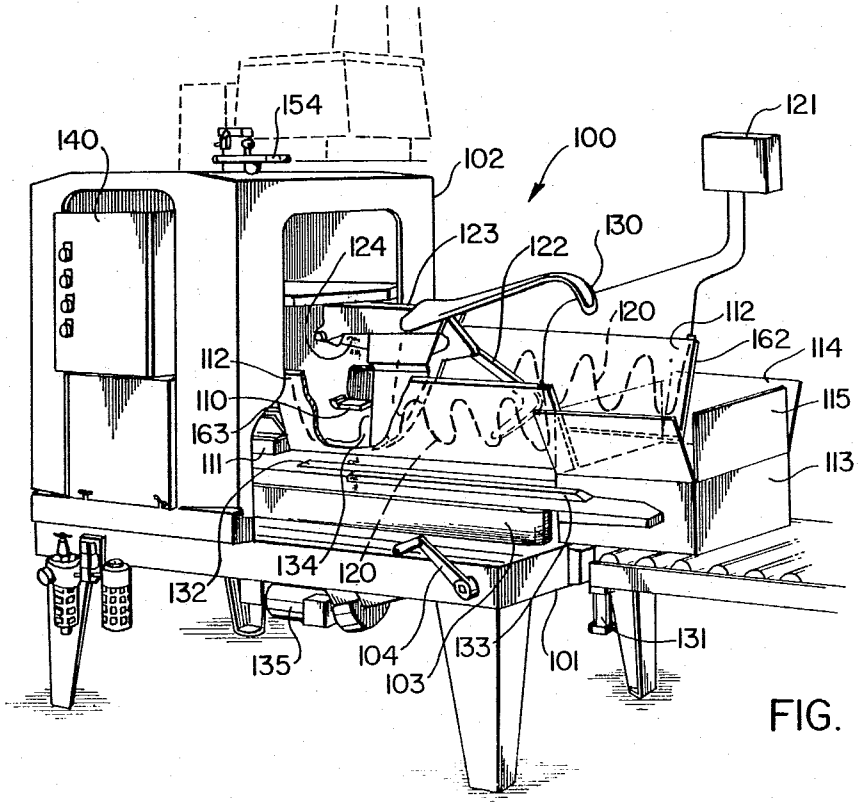
FIG. 1 is an isometric view of a packaging machine according to one aspect of the invention.

Referring now to FIG. 1, an automatic case sealer is partially shown generally at 100. It comprises a frame 101, a machine cover 102, a pair of side conveyors 103, the width of which is adjustable by rotation of handle 104, a glue or adhesive applicator 110 and a compression platen 111 for applying pressure to the surfaces to be bonded.

Figure 2:
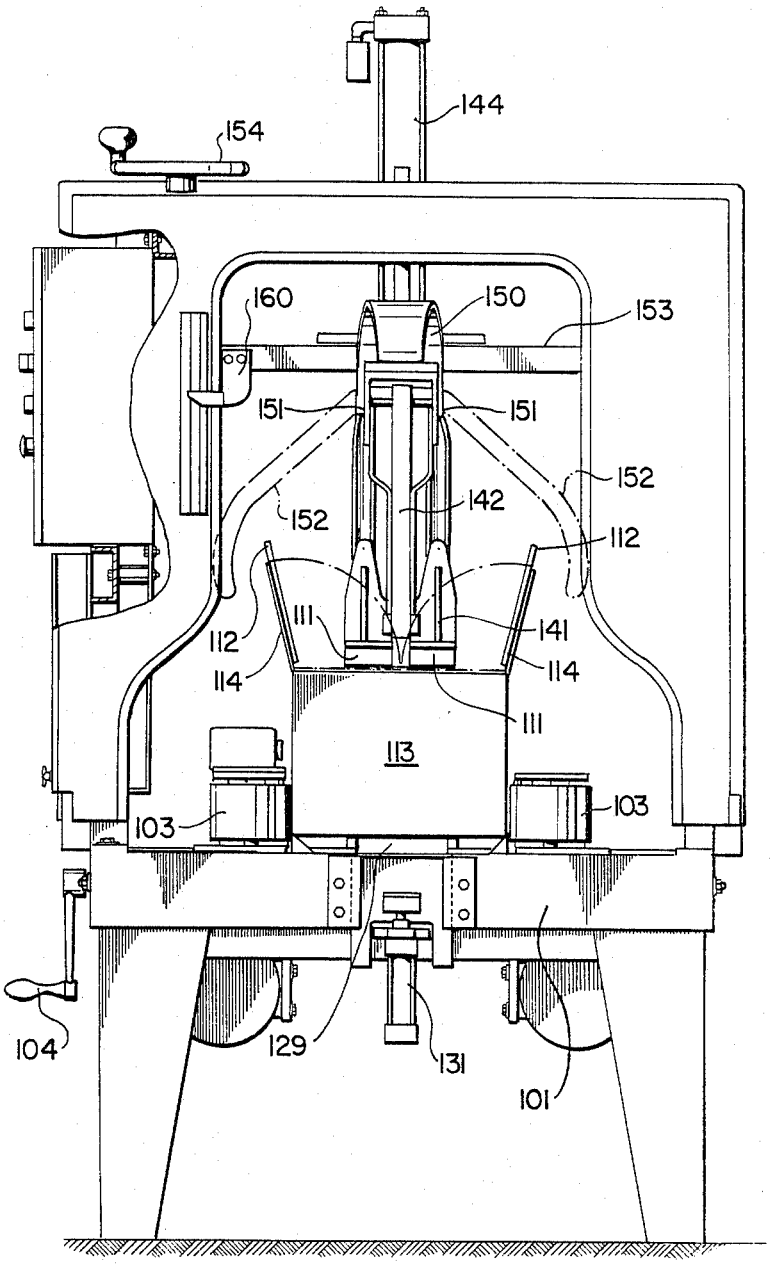
FIG. 2 is an end view of the apparatus of FIG. 1 with a container shown in phantom in both the open and closed positions.

A pair of flap heaters 112 are mounted angularly facing outwardly and extending adjacent to and along the path of travel of the corrugated container 113 as best seen in FIG. 2. The flap heaters 112 are adapted to contact substantially the entire outer surfaces of the corrugated assemblies which make up the major flaps 114 of the corrugated container 113 prior to the major flaps 114 being folded downwardly as will be explained.

A heating element 120 extends within and along the extent of each of the flap heaters 112 and these elements 120 are each connected to a source of voltage 121 sufficient to provide the required temperature to the flap heaters 112.

A kicker 122 is mounted within a kicker frame 123 and operates by pneumatic cylinder 124 to fold the minor flaps 115 of the corrugated container 113. A kicker guard 130 acts for safety purposes to prevent contact of the kicker 122 with operating personnel when in operating condition.

A stop gate 129 is mounted on frame 101 and is reciprocated vertically under the control of a pneumatic stop gate cylinder 131. A sensor long box 132 is mounted on frame 101 to provide correct synchronization of machine motion and container position, and a pair of side guides 133 locate the container 113 laterally when the container 113 passes to the compression section of the case sealer 100. A centre ski 134 holds the minor flaps 115 in the down or closed position as the container 113 passes through the case sealer 100.

A motor and gear box 135 are connected to frame 101 and provide power and necessary gear reduction to the various components. A control panel 140 provides the necessary control functions to the motor and gear box 135 and to the other assembly functions included in the case sealer 100.

Referring to FIG. 2, the flap heaters 112 are seen in an end configuration. The angle of the flap heaters 112 is adjustable but for typical operations using corrugated containers 113 having width dimensions of from six (6) inches to twenty (20) inches, it has been found that an angle of thirteen (13) degrees from the vertical is suitable.

Each compression platen 111 is connected to a support bracket 141 and each support bracket 141 is attached to an extension 142 connected to piston rod 143 extending from and reciprocal within pneumatic cylinder 144. A casting assembly 150 is connected to the lower portion of pneumatic cylinder 144 and provides support for cam rollers 151 which provide control to the folding arm assemblies 152. Pneumatic cylinder 144 is supported by a movable support frame 153 under the control of a height adjustment control 154. An indexing device 160 provides height information by reference. Appropriate sensors 161 are provided in the sensor long box 132 to give the apparatus positioning information for the corrugated container 113.

OPERATION

In operation, a corrugated container 113 will ordinarily proceed to the stop gate 129 on a conveyor (not shown). The box will contain goods which have been placed in the container 113 at a previous operating station and the major and minor flaps of the bottom of the box will ordinarily have been previously bonded. The top major flaps 114 and the top minor flaps 115 will be open. The major flaps 114 are located outwardly of the flap heaters 112 as illustrated in FIGS. 1 and 2.

The stop gate 129 will normally be in a raised position so that the container 113 will abut the stop gate 130 and the container 113 will temporarily stop prior to proceeding. When the operations on the previous container have been completed, stop gate cylinder 131 will be activated and stop gate 129 will drop to its down position. The side conveyors 103 will have been previously adjusted to the proper width of the container 113 by handle 104 and, when the stop gate 129 drops, the container 113 is conveyed into case sealer 100 by side conveyors 103.

As the major flaps 114 of corrugated container 113 move past the leading edge 162 of the flap heaters 112, they directly contact the heater 112 because of the pretension forces attempting to direct the major flaps 114 inwardly. The heaters 112 transmit heat by conduction directly to the major flaps 114 during the conveyancing action until the major flaps 114 leave contact with the lagging edge 163 of the flap heaters 112. Simultaneously with the application of heat to the major flaps 114, the centre ski 134 has closed the forward minor flap (not shown) and the kicker 122 has contacted and closed the rearward minor flap 115. Adhesive from the adhesive applicator 110 is applied to the upwardly facing surfaces of the closed minor flaps 115, which adhesive flow is interrupted appropriately to avoid the centrally located gap between the minor flaps 115 when they are in the closed position.

After the container 113 has left the vicinity of the heaters 112, the major flaps 114 are free to be closed and pneumatic cylinder 144 is activated. Upon activation of pneumatic cylinder 144, the compression platen 111 travels downwardly from the upper inoperative position to a position where the platen 111 contacts the major flaps 114. During the downwardly travel of the compression platen 111, the rollers 151 moving within the cam surfaces (not shown) on folding arm assemblies 152 close the folding arm assemblies 152 which, in turn, contact the outwardly extending heated major flaps 114 and close them. Following contact between the surfaces of the major flaps 114 and the closed minor flaps 115 carrying the adhesive applied from the adhesive applicator 110, the compression platen 111 applies pressure for a predetermined duration until the surfaces are bonded. Thereafter, the closed container 113 is conveyed out of the case sealer 100 and the case sealer is ready to perform identical operations on the succeeding container.

In tests which have been conducted to date, it has been found that a temperature for the flap heaters 112 of approximately 100° C. is adequate for flap heating with a conveyor travel speed of 120 feet per minute. The compression platen 111 has been found to give an adequate bond with a contact time of approximately one (1) second. Of course, these figures are interdependent and are only of interest if the other perameters are known. For example, the adhesive used in the operations is a water based polyvinyl acetate emulsion known as NACAN 33-1557 (Trade Mark) which is applied at an ambient temperature of 20° C. If, for example, the speed of the conveyors 103 is increased, the temperature of the flap heaters 112 could also be increased to compensate for the reduced contact time between the major flaps and the flap heaters 112.

In addition to the specific embodiment of the invention relating to the bonding of corrugated elements, it may be desired to rapidly bond cardboard, paper or tape with a second like element. Because the cardboard, paper or tape may have a relatively higher coefficient of conductivity, the insulating properties due to the corrugated paper elements are not present and the element may be heated more rapidly. It is thus not necessary to apply heat prior to contact occurring between the surfaces. Instead, the application of heat to the paper, tape or cardboard after the joint has been assembled immediately heats the adhesive between the surfaces and bonding speed is similarly improved.

While specific embodiments of the invention have been described, these embodiments should be considered as illustrative only and not as limiting the scope of the invention. Many modifications to the embodiments described may be contemplated by those skilled in the art which will fall within the scope and spirit of the invention, which invention should be construed by reference to the accompanying claims.

I claim:

1. Apparatus for bonding together the outer surfaces of two corrugated paperboard assemblies comprising heat applying means to rapidly raise the temperature of one of the surfaces to a predetermined value, while said one surface is being conveyed, adhesive applying means to apply adhesive to the other of said surfaces, closing means to bring said surfaces into contact and pressure means to apply pressure between said contacting surfaces.

2. Apparatus as in claim 1 wherein said heat applying means is a temperature adjustable plate operable to contact one of said surfaces and to provide said heat transfer between said plate and said surface by conduction.

3. Apparatus as in claim 2 wherein said adhesive applying means is an apparatus operable to apply adhesive at ambient temperatures.

4. Apparatus as in claim 1 wherein said predetermined temperature value of said one of said surfaces is substantially higher than the temperature of the other of said surfaces.

5. Apparatus as in claim 3 wherein said temperature adjustable plate provides a temperature of between 60° C. and 200° C.

6. Apparatus as in claim 3 wherein said surfaces are the flaps of a corrugated cardboard container and said heat applying means is a plate operable to contact at least one of said flaps.

7. A method for rapidly bonding the outer surfaces of two corrugated paperboard assemblies comprising the steps of applying heat directly to one of said surfaces, applying adhesive at ambient temperature to the other of said surfaces, bringing said surfaces into a contacting relationship and applying pressure between said surfaces.

8. A method as in claim 7 and further comprising providing relative movement of said surfaces while directly applying said heat.

9. A method as in claim 8 wherein said heat is applied simultaneously with the application of said adhesive.

10. A method as in claim 9 wherein said surfaces are brought into said contacting relationship after said heat has been applied and said pressure is applied directly to said surfaces.

11. A method of bonding the surface of a first corrugated paperboard assembly with the surface of a second corrugated paperboard assembly comprising the steps of applying adhesive to said surface of said first assembly at ambient temperature, bringing said surface of said second assembly into contact with said surface of said first assembly at ambient temperature and applying heat at a predetermined temperature to one of said surfaces.

12. The method of claim 11 wherein said heat is applied conductively to said first element.

* * * * *